US006611315B2

(12) United States Patent
Hashiguchi

(10) Patent No.: US 6,611,315 B2
(45) Date of Patent: Aug. 26, 2003

(54) THERMAL DEVELOPMENT SHEET COOLING METHOD, AND THERMAL DEVELOPMENT APPARATUS

(75) Inventor: Akihiro Hashiguchi, Kanagawa (JP)

(73) Assignee: Fuji Photo Film Co., Ltd., Ashigara (JP)

( * ) Notice: Subject to any disclaimer, the term of this patent is extended or adjusted under 35 U.S.C. 154(b) by 0 days.

(21) Appl. No.: 09/994,682

(22) Filed: Nov. 28, 2001

(65) Prior Publication Data

US 2002/0075463 A1 Jun. 20, 2002

(30) Foreign Application Priority Data

Nov. 30, 2000 (JP) ..... A-2000-365314

(51) Int. Cl.[7] ..... G03B 27/32; G03B 27/52; G03B 15/20

(52) U.S. Cl. ..... 355/27; 355/30; 399/69

(58) Field of Search ..... 355/27, 30; 399/69, 399/94, 119, 222, 252; 430/353

(56) References Cited

U.S. PATENT DOCUMENTS 5,849,388 A * 12/1998 Preszler et al. ..... 34/575

6,350,568 B2 * 2/2002 Yamazaki ..... 430/264

FOREIGN PATENT DOCUMENTS

JP 2000-98577 B1 4/2000
JP 2000-241928 B1 9/2000

* cited by examiner

*Primary Examiner*—Rodney Fuller

(57) ABSTRACT

A thermal development sheet cooling method including a first cooling step of employing, at a temperature lower than a development temperature, a rotary member pair to sandwich and feed a thermal development sheet to suppress further development progression; a second cooling step of feeding the thermal development sheet in a non-contact state a predetermined distance through the air at a temperature lower than the temperature of the rotary member pair, thereby cooling the thermal development sheet while the inherent weight thereof induces curling; and a third cooling step of feeding the declined thermal development sheet while in contact with a guide member, and of cooling the thermal development sheet to a temperature equal to or lower than a softening point temperature of a sheet support member, while correcting the curled shape of the sheet.

2 Claims, 4 Drawing Sheets

THERMAL DEVELOPMENT SHEET COOLING METHOD, AND THERMAL DEVELOPMENT APPARATUS

BACKGROUND OF THE INVENTION

1. Field of the Invention

The present invention relates to a thermal development apparatus and a cooling method therefor, and in particular relates to a dry thermal development apparatus, for performing a heating process using a thermal development sheet that does not require a wet process, and a cooling method therefor.

2. Description of the Related Art

Conventionally, a wet system that develops or records an image on a silver halide photographic photosensitive material and performs a wet process to obtain the image, has been employed for a plate making image recording apparatus that prepares a plate for printing, on an image recording apparatus, such as is used for digital radiography, CT or MRI, that records medical images using a heat-accumulating fluorescent sheet.

Recently, the focus has been on a thermal development apparatus that employs a dry system rather than a wet process. This thermal development apparatus employs a photosensitive and/or thermal sensitive recording material (photo/thermal sensitive recording material) film or a thermal development photosensitive material film (hereinafter referred to as a thermal development sheet). In a thermal development apparatus using the dry system, an exposure unit uses a laser beam to irradiate onto (scan on) a recording material and form a latent image. Such a thermal development unit performs the thermal development process by bringing a thermal development sheet into contact with heating means, uses a cooling unit to cool the thermal development sheet on which the image is formed, and then discharges the sheet to the outside.

Since the dry system requires less time to form an image than does the wet system, and since a problem presented by the waste fluid generated by the wet process is eliminated, it is strongly anticipated that in the future the demand for the use of the dry system will increase.

A conventional thermal development apparatus is disclosed in JP (OPI) 2000-98577, for example, and the thermal development apparatus disclosed in this publication will now be described while referring to FIG. 4.

In a thermal development apparatus 60, a thermal development unit 62 is used to develop a thermal development sheet A1, which thereafter is fed by a pair of feeding rollers 62A and 62B to a cooling unit 63, including a cooling member 65 having a curved face 65A and a linear portion 65B. The thermal development sheet A1 is thus cooled until a development stop temperature is reached, whereafter it is discharged by a pair of discharge rollers 64A and 64B.

At this time, since the speed at which the discharge rollers 64A and 64B convey the thermal development sheet A1 is higher than the speed imparted by the feed rollers 62A and 62B, the thermal development sheet A1 can be forcefully guided along the curved face 65A of the cooling member 65 while the temperature of the sheet A1 is higher than the softening point temperature. Therefore, the rigidity of a thermal development sheet A1 is increased to limit the degree to which it is physically deformed, and thereafter, as the sheet A1 advances along the linear portion 65B of the cooling member 65, its permanent deformation (curling) is prevented.

However, in the thermal development apparatus 60, between the thermal development unit 61 and the cooling unit 63, an area for maintaining the thermal development sheet at a development stop temperature is not clearly defined by partition walls. Therefore, the quality of a developed image will vary due to changes in the external temperature and differences in the temperature characteristics of the thermal development sheet.

In addition, in order to stretch the thermal development sheet A1 and remove creases, the sheet A1 is conveyed while forcefully pressed against the curved face 65A of the cooling member 65. However, when the thermal development sheet A1 is pressed against the curved face 65A at a temperature lower than that of the softening point, vertical creases that parallel the direction in which the thermal development sheet A1 is conveyed will not be removed.

SUMMARY OF THE INVENTION

To resolve the abovementioned shortcomings, it is one objective of the present invention to provide a thermal development apparatus for preventing the deterioration of image quality due to a temperature change in a cooling space used for halting development, and for preventing the occurrence of vertical creases in a thermal development sheet and a cooling method therefor.

To achieve the above objective, according to a first aspect of the invention, a thermal development sheet cooling method, for cooling a thermal development sheet that is thermally developed at a predetermined development temperature, comprises:

a first cooling step of employing a rotary member pair, kept at a temperature lower than a development temperature, to sandwich and feed a thermal development sheet that has been developed, and of reducing the temperature of the thermal development sheet to suppress further development progression;

a second cooling step of, following the discharge of the thermal development sheet from the rotary member pair, feeding the thermal development sheet in a non-contact state a predetermined distance through the air at a temperature lower than the temperature of the rotary member pair, thereby cooling the thermal development sheet while the inherent weight thereof induces curling; and a third cooling step of feeding the thermal development sheet while in contact with a guide member, and of cooling the thermal development sheet to a temperature equal to or lower than a softening point temperature of a sheet support member, wherein the cooling of the thermal development sheet is accomplished in the first to the third cooling steps.

By the thermal development method, since in the first cooling area, immediately following the thermal development process, the thermal development sheet is sandwiched and fed by the rotary member pair at a predetermined temperature that is lower than the development temperature, the temperature of the thermal development sheet is reduced and further development progression is suppressed. Therefore, since the development time can be rigorously managed, image quality is less affected by changes in the external temperature.

In the second cooling area, since the thermal development sheet in the non-contact state is fed a predetermined distance through the air at a temperature lower than the temperature of the rotary member pair, the thermal development sheet is cooled while its inherent weight induces its curling.

Therefore, a thermal development sheet that becomes soft at a temperature higher than the softening point temperature of the sheet support member can be naturally cooled without imposing an external load on the sheet, so that the occurrence of vertical creases in the thermal development sheet can be prevented. Further, the rigidity of a thermal development sheet can be increased when its curling is induced by its inherent weight.

In the third cooling area, a thermal development sheet is fed while in contact with the guide member, and is cooled to a temperature equal to or lower than the softening point temperature of the sheet supporter. Therefore, the curling direction of the thermal development sheet is forcibly altered by winding the curled sheet in the opposite direction, thereby returning the sheet to its original plane shape. Furthermore, additional rigidity is imparted to the thermal development sheet when it is wound in the opposite direction.

According to a second aspect, a thermal development apparatus comprises:

a cooling unit, for cooling a thermal development sheet that is thermally developed at a predetermined development temperature, wherein the cooling unit includes a first cooling area, wherein the cooling unit employs a rotary member pair, kept at a temperature lower than a development temperature, to sandwich and feed the thermal development sheet that is developed, and reduces the temperature of the thermal development sheet to suppress further development progression, a second cooling area, wherein, following the discharge of the thermal development sheet from the rotary member pair, the cooling unit feeds the thermal development sheet in a non-contact state a predetermined distance through the air at a temperature lower than the temperature of the rotary member pair, thereby cooling the thermal development sheet while the inherent weight thereof induces curling, a third cooling area, wherein a guide member is provided along which the thermal development sheet is sandwiched and fed to correct the curved shape thereof, and wherein the cooling unit cools the thermal development sheet to the temperature of a sheet support member that is equal to or lower than a softening point temperature; and a fourth cooling area, wherein discharge rollers are provided for sandwiching and for discharging to the outside the thermal development sheet that is fed along the guide member, and wherein the temperature of the thermal development sheet is further reduced.

In the thermal development apparatus, since in the first cooling area, immediately following the thermal development process, the thermal development sheet is sandwiched and fed by the rotary member pair at a predetermined temperature that is lower than the development temperature, the temperature of the thermal development sheet is reduced and further development progression is suppressed. Therefore, since the development time can be rigorously managed, image quality is less affected by changes in the external temperature.

In the second cooling area, since the thermal development sheet in the non-contact state is fed a predetermined distance through the air at a temperature lower than the temperature of the rotary member pair, the thermal development sheet is cooled while its inherent weight induces its curling. Therefore, a thermal development sheet that becomes soft at a temperature higher than the softening point temperature of the sheet support member can be naturally cooled without imposing an external load on the sheet, so that the occurrence of vertical creases in the thermal development sheet can be prevented. Further, the rigidity of a thermal development sheet can be increased when its curling is induced by its inherent weight.

In the third cooling area, a thermal development sheet is fed while in contact with the guide member, and is cooled to a temperature equal to or lower than the softening point temperature of the sheet supporter. Therefore, the thermal development sheet, while contacting the guide member, is gradually cooled to a temperature equal to or lower than the softening point temperature of the sheet support member, while at the same time, the curling direction is forcibly altered by winding the curled sheet in the opposite direction, thereby returning the sheet to its original plane shape. Furthermore, additional rigidity is imparted to the thermal development sheet when it is wound in the opposite direction.

In the fourth cooling area, discharge rollers are provided for sandwiching a thermal development sheet and reducing its temperature, while conveying it along the guide member and then discharging it to the exterior. With this arrangement, once the thermal development sheet has been discharged it is cool enough to be picked up and handled by hand.

DESCRIPTION OF THE PREFERRED EMBODIMENTS

A thermal development apparatus and a cooling method in accordance with the preferred embodiment of the present invention will now be described in detail while referring to the accompanying drawings.

Figure 1:
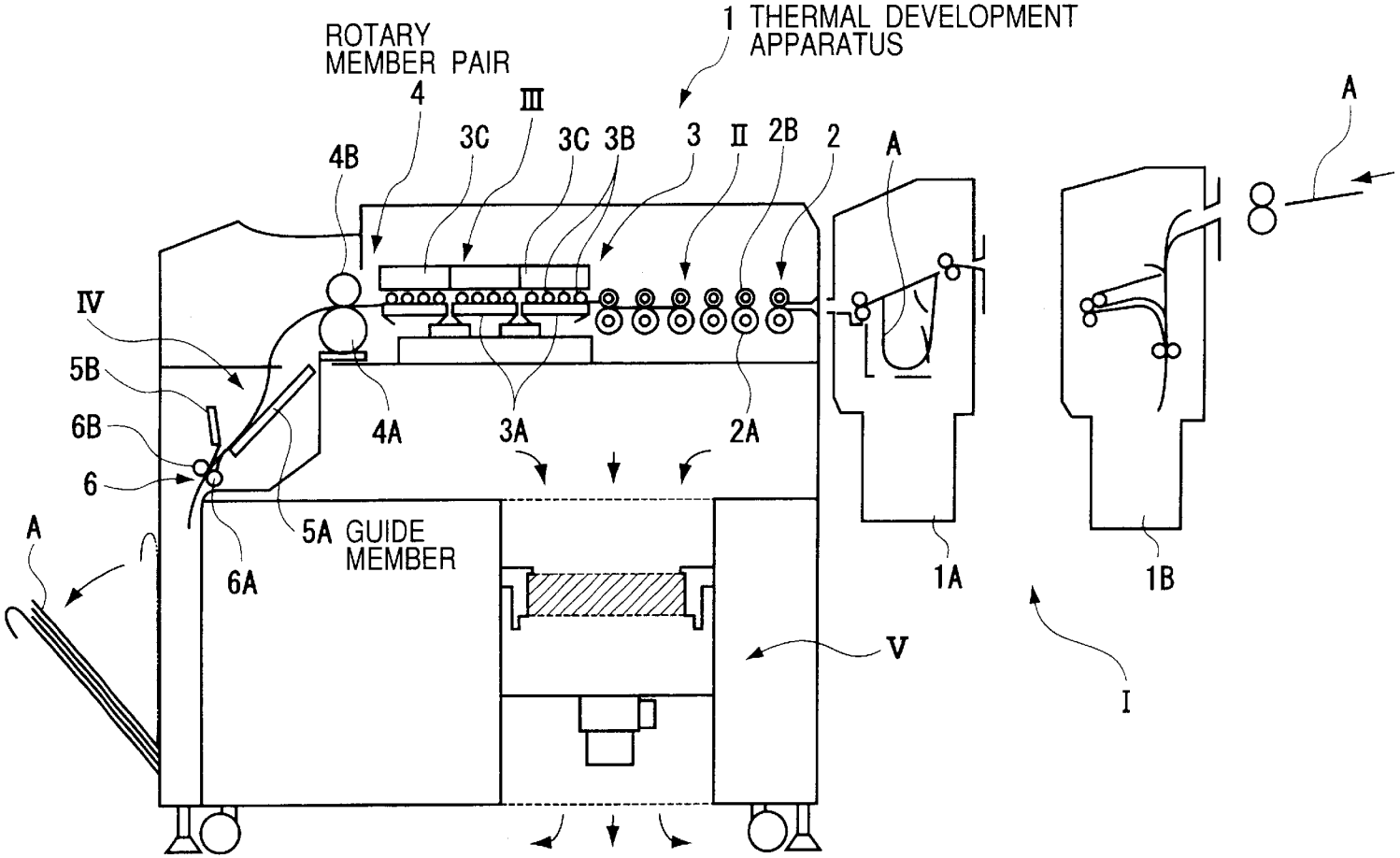
FIG. 1 is a side view of a thermal development apparatus according to the present invention.

FIG. 1 is a schematic diagram showing the configuration of a thermal development apparatus according to the invention.

A thermal development apparatus 1 according to this embodiment thermally develops a thermal development sheet A that is specifically prepared using a thermal development photosensitive material described in JP (OPI) P2000-241928A. Thus, for the thermal development sheet A, an image forming layer that is applied to a sheet supporter (of glass fiber) contains, at the least, (a) non-photographic organic silver halide, (b) photosensitive silver halide, (c) a reduction agent and (d) a nucleator, while a 50 weight % or greater portion of the binder used for the image forming layer is composed of polymer latex having a glass transfer temperature of between −30° C. and 40° C. After the image forming layer has been coated on the sheet supporter and dried, the resultant structure is thermally processed at a film surface temperature of from 30° C. to 70° C., which is equal to or lower than the glass transfer temperature of the sheet supporter.

As is shown in FIG. 1, the thermal development apparatus 1 primarily comprises: a conveyer I, for feeding a thermal development sheet A on which a latent image is formed; a preliminary heater II, for performing the preliminary heating of the thermal development sheet A; a development unit III, for thermally developing the thermal development sheet A on which the latent image is formed; a cooling unit IV, for gradually cooling the thermal development sheet A after it has been developed at a predetermined development temperature; and an exhaust unit V, for expelling gas that is generated in the apparatus.

The conveyer I is an interface member for supplying, to the preliminary heater II, a thermal development sheet A on which a latent image is formed by exposure using a plotter (not shown). The conveyer I includes a conveyer 1A, for which the thermal development sheets A of A1 and A2 size can be employed, that reduces the speed at which a sheet A is supplied by the plotter, and a conveyer 1B, for which the thermal development sheet A of only A2 size is employed, that can perform a side inversion process. Depending on the purpose for which the thermal development apparatus is employed, one of the conveyers 1A and 1B is selected and employed.

In the preliminary heater II, multiple pairs of nip rollers 2, each pair of which comprises a heating roller 2A and a feeding roller 2B, are positioned at like intervals in the direction in which a thermal development sheet A is fed.

The intervals and the temperatures set for the heating rollers 2A are arranged so that temperatures applied by individual heating rollers 2A rise progressively the nearer the heating rollers 2A are to the development unit III, and so that when a thermal development sheet A is carried past the last heating roller 2A and enters the developing unit III, uneven development due to a sudden thermal change does not occur.

In the development unit III, multiple heating units 3, each of which includes a heating plate 3A, multiple conveying rollers 3B, which are located above the heating plate 3A, and an auxiliary heating member 3C, are arranged in the direction in which a thermal development sheet A is fed. While a thermal development sheet A is sandwiched and fed by the heating plates 3A and the conveying rollers 3B, the heating plates 3A and the auxiliary heating members 3C develop the sheet A by raising its temperature to the development level. Thereafter, the thermal development sheet A is moved to the cooling unit IV.

Figure 2:
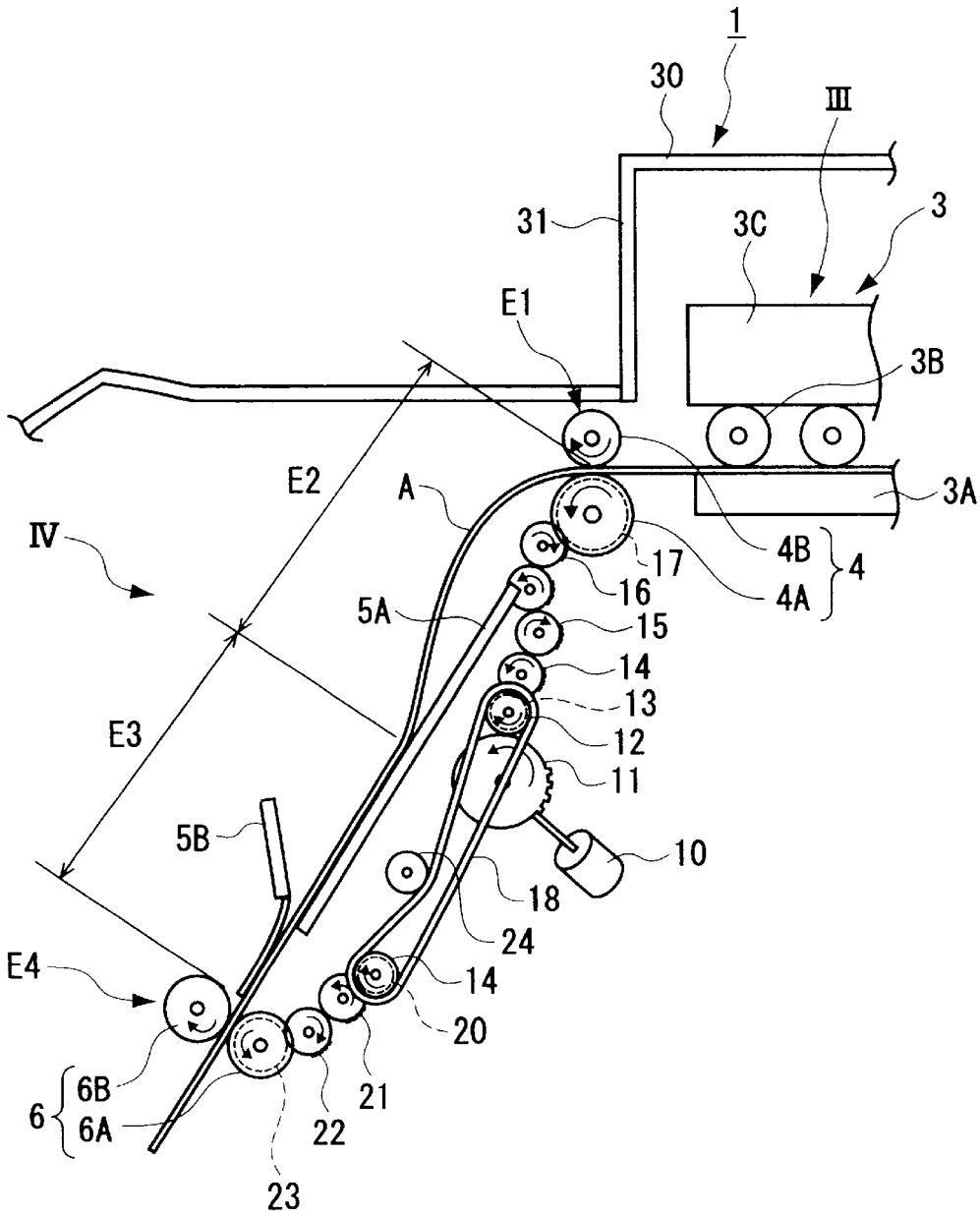
FIG. 2 is an enlarged diagram of the essential portion of the thermal development apparatus according to the invention.

As is shown in FIG. 2, the cooling unit IV includes: a first cooling area E1, whereat after a thermal development sheet A is developed it is sandwiched and fed by a pair of feeding rollers 4A and 4B (i.e., a rotary member pair 4) that provide a cooling temperature, lower than the development temperature, that reduces the sheet A temperature and suppresses further development progression; a second cooling area E2, whereat the thermal development sheet A in a non-contact state is fed a predetermined distance through the air at a temperature that is lower than the cooling temperature applied by the rotary member pair 4, so that the thermal development sheet A is cooled while bending downward under its own weight; a third cooling area E3, whereat a guide member 5A is provided along which the thermal development sheet A is fed to remove the bend, and whereat the temperature of the thermal development sheet A is further reduced until it is equal to or lower than the softening point temperature of the sheet supporter; and a fourth cooling area E4, whereat discharge rollers 6A and 6B (i.e., a rotary member pair 6) are provided for discharging, to the outside of the apparatus, the thermal development sheet A that is sandwiched and fed while contacting the guide member 5A, and whereat the sheet temperature is further reduced.

An auxiliary guide member 5B is positioned opposite the guide member 5A to properly guide the thermal development sheet A to the discharge rollers 6A and 6B.

The feed roller 4A is a metal roller having a surface temperature that is maintained at about 112.5° C. by a ceramics heater. The feed roller 4B is a rubber roller that is coupled and rotated in unison with the feed roller 4A. The temperature of the first cooling area E1 is controlled, so that heat is removed from the feed roller 4A by the thermal development sheet A and the coupled feed roller 4B and the sheet temperature is reduced to 110° C., which is lower than the development temperature.

When one drive motor 10 in FIG. 2 is driven, the feed rollers 4A and 4B and the discharge rollers 6A and 6B are rotated in the directions indicated by arrows. That is, when the drive motor 10 is driven, a gear 11 is rotated and its rotation is transmitted to a gear 13 coaxial with an upper pulley 12, thereby rotating the gears 14, 15 and 16. Since the rotation of the gear 16 is transmitted to a gear 17 coaxial with the feed roller 4A, the feed roller 4A is rotated in the direction as indicated by the arrow, and the feed roller 4B, which is coupled with the feed roller 4A, is also rotated.

The rotation of the upper pulley 12 is transmitted via a belt 18 to a lower pulley 19.

As the lower pulley 19 is rotated, gears 21 and 22 are rotated via a gear 20 that is coaxial with the lower pulley 19. And since the rotation of the gear 22 is transmitted to a gear 23 that is coaxial with the discharge roller 6A, the discharge roller 6A is rotated in the direction indicated by an arrow, and the discharge roller 6B, which is coupled with the discharge roller 6A, is also rotated. A pulley 24 adjusts the tension of the belt 18.

The relationship between the speeds of the feed rollers 4A and 4B and the discharge rollers 6A and 6B, both sets of which are used to convey the thermal development sheet A, is set so that while the thermal development sheet A is passing through the cooling unit IV, in the second cooling area E2, the sheet A can be bent under its own weight, and in the third cooling area E3, the curled sheet A is conveyed to the guide member 5A to correct its shape.

The guide member 5A is formed of a material having a thermal conductivity that is equal to or lower than 1 Kcal/m.h.° C. When the thermal conductivity is low, it is possible to prevent heat from being too quickly removed from a thermal development sheet A when the sheet A contacts the guide member 5A.

The materials that have low thermal conductivities are polycarbonate (PC), polyphenylene sulfide (PPS), polyimide (PI), polyethylene (PE), polyethylene terephthalate (PET), polyvinyl chloride (PVC), acrylonitrile butadiene styrene resin (ABS), polyamide (PA), polyether sulfone (PES), polyamideimide (PAI), polyaccetals (POM), fluorine resin, Bakelite and glass.

As is shown in FIG. 2, a partition wall 31 is formed for an upper casing 30 of the thermal development apparatus 1. The development unit III and the cooling unit IV can be defined by the partition wall 31 and by the heat shielding action of the feed rollers 4A and 4B. As a result, the development unit III is less affected by the cooling unit IV, and especially in the second half portion of the development area the temperature is stabilized. The cooling unit IV takes in fresh air from the outside, and the adverse affects occurring due to changes in the environmental temperature can also be prevented. Therefore, changes in the image quality due to development time variances can be suppressed.

Figure 3:
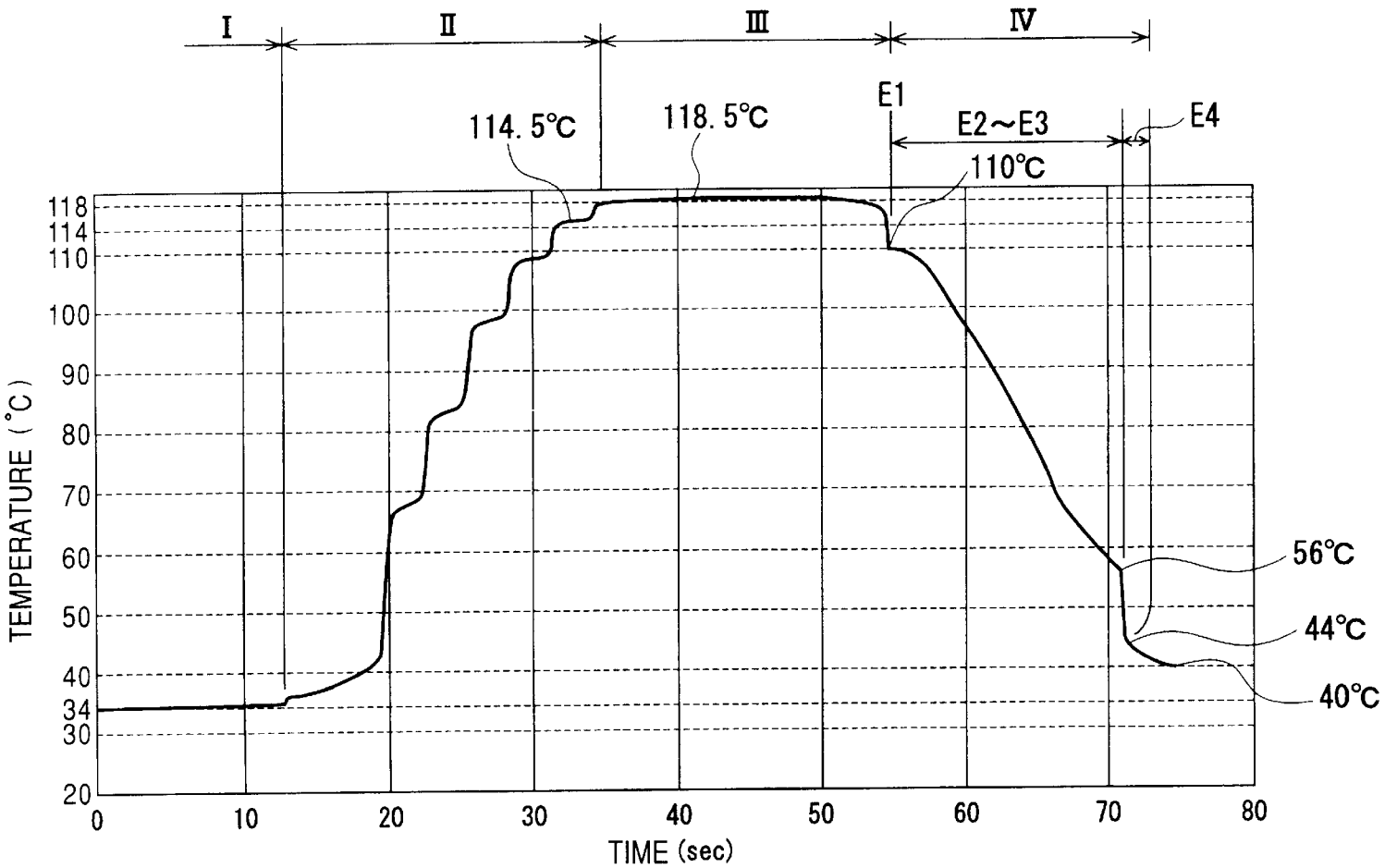
FIG. 3 is a graph for explaining a cooling method employed by the thermal development apparatus according to the invention.
Figure 4:
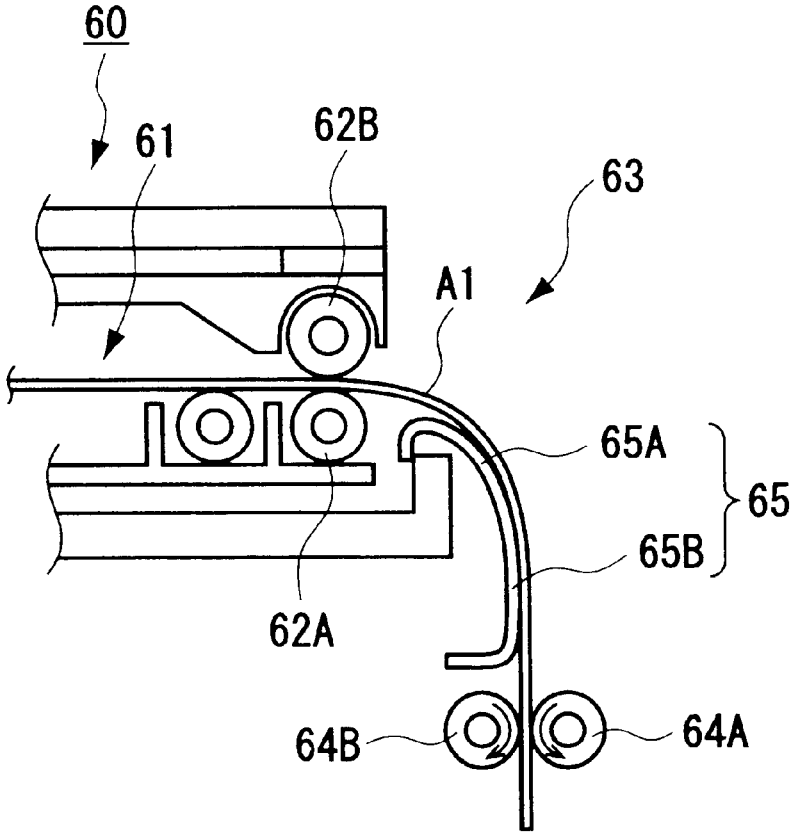
FIG. 4 PRIOR ART
FIG. 4 is a cross-sectional view of a conventional thermal development apparatus.

An explanation will now be given, while referring to FIG. 3, for an example wherein the conveyer 1A is employed for the cooling method of the thermal development apparatus 1.

First, a thermal development sheet A, for which the feeding speed is adjusted or an inversion process is performed, is fed by the conveyer 1A between the heat rollers 2A and the feed rollers 2B of the preliminary heater II. As the thermal development sheet A is passed through each heat roller 2A and feed roller 2B pair, the temperature of the sheet A is raised step by step from about 34° C. to the thermal development temperature of 114.5° C.

Sequentially, the thermal development sheet A is conveyed to the development unit III. Then, while the thermal development sheet A is fed by the heat plates 3A and the convey rollers 3B, the temperature of the sheet A is raised from 114.5° C. to the target development temperature of 118.5° C. While this temperature is maintained, heat is applied for a predetermined period of time to the thermal development sheet A, which is then conveyed to the cooling unit IV.

Subsequently, the thermal development apparatus 1 performs the first cooling step in the first cooling area E1 of the cooling unit IV. Specifically, the thermal development sheet A, the temperature of which has been raised to the development temperature of 118.5° C. by the development unit III, is sandwiched and fed by the rotary member pair 4 (the pair of feed rollers 4A and 4B) for which a temperature is provided that is lower than the development temperature. Thus, the sheet temperature is reduced to 110° C. and further development progression is suppressed.

The level of the 110° C. temperature is such that the difference between it and the 118.5° C. development temperature does not constitute a physical change that will result in deterioration, of the quality of the image on the thermal development sheet A, that can be detected. Therefore, further development progression can be suppressed (halted), and the effect of a variance in the development time due to a change in the external temperature can be minimized, so that deterioration of the image quality can be prevented. That is, if the rotary member pair 4 were not provided, the spatial temperature of the cooling unit IV would be affected, even though slightly, by the external temperature and the development time would be varied.

Since the partition wall 31 is provided near the first cooling area E1 for the upper casing 30 of the thermal development apparatus 1, and since it defines the development unit III and the cooling unit IV, the transfer of heat from the development unit III to the cooling unit IV can be prevented, and the time required for the development of the thermal development sheet A can be more accurately managed.

Next, the thermal development apparatus 1 performs the second cooling step in the second cooling area E2 of the cooling unit IV. Specifically, the thermal development sheet A is fed in the non-contact state a predetermined distance through the air at a temperature that is lower than the cooling temperature of the rotary member pair 4. As a result, the thermal development sheet A is naturally cooled while bending down under its own weight.

While the further development progression of the thermal development sheet A has been halted in the first cooling area E1, the sheet A is still soft since its temperature continues to exceed the softening point temperature of the sheet support member. Therefore, in the second cooling area E2, this sheet A is gradually cooled without any external load being imposed on it. That is, when the thermal development sheet A in the non-contact state is conveyed through the air and bends under its own weight, as little external load as possible is imposed on it and an increased rigidity is imparted to it that prevents physical deformation due to the drastic change in its temperature.

Following this, the thermal development apparatus 1 performs the third cooling step in the third cooling area E3 of the cooling unit IV. Specifically, the thermal development sheet A is fed while in contact with the guide member 5A, and is cooled until its temperature is equal to or lower than 60° C. (about 56° C.), which is lower than the softening point temperature (about 80° C.) of the sheet support member.

That is, the thermal development sheet A that in the second cooling area E2 bent down under its own weight is bent curled in the opposite direction by bringing it into contact with the guide member 5A. As a result, the shape of the thermal development sheet A is corrected, and the rigidity of the thermal development sheet A is increased even more, so that its physical deformation can be prevented. Therefore, the deterioration of image quality due to the physical deformation of the sheet A during the cooling process can be suppressed.

Furthermore, in the third cooling area E3, the naturally bent thermal development sheet A can be forcibly bent in the opposite direction. And thereafter, the thermal development sheet A, which is now substantially flat and extends along the plane of the guide member 5A, can be fed further while it is cooled and its temperature is reduced until it is a little less than 60° C., which is lower than the softening point temperature. As a result, when the thermal development sheet A is discharged, the bend in will have been removed.

Finally, the thermal development apparatus 1 performs the fourth cooling step in the fourth cooling area E4 of the cooling unit IV. Specifically, the thermal development sheet A that has been fed while in contact with the guide member 5A is sandwiched and conveyed by the discharge rollers 6A and 6B. At this time, the sheet temperature is reduced even further, from a little below 60° C. (about 56° C.) to a little above 40° C. (about 44° C.), a temperature whereat the thermal development sheet A can be lifted and held in the hands. Thus, the time delay required before the discharged thermal development sheet A can be picked up and carried to a succeeding step can be reduced.

As is described above, by the thermal development method of the first aspect of the invention, since in the first cooling area, immediately following the thermal development process, the thermal development sheet is sandwiched and fed by the rotary member pair at a predetermined temperature that is lower than the development temperature, the temperature of the thermal development sheet is reduced and further development progression is suppressed. Therefore, since the development time can be rigorously managed, image quality is less affected by changes in the external temperature, and the deterioration of the image quality due to the difference in the development time can be suppressed.

In the second cooling area, since the thermal development sheet in the non-contact state is fed a predetermined distance through the air at a temperature lower than the temperature of the rotary member pair, the thermal development sheet is cooled while its inherent weight induces its curling. Therefore, a thermal development sheet that becomes soft at a temperature higher than the softening point temperature of the sheet support member can be naturally cooled without imposing an external load on the sheet, so that the occurrence of vertical creases in the thermal development sheet can be prevented. Further, the rigidity of a thermal development sheet can be increased when its curling is induced by its inherent weight. In addition, since the thermal development sheet is forcibly bent in the opposite direction, an increased rigidity is imparted to the thermal development sheet, and the deterioration of image quality due to physical deformation occurring during the cooling process can be suppressed.

In the third cooling area, a thermal development sheet is fed while in contact with the guide member, and is cooled to a temperature equal to or lower than the softening point temperature of the sheet supporter. Therefore, the curling direction of the thermal development sheet is forcibly altered by winding the curled sheet in the opposite direction, thereby returning the sheet to its original plane shape.

According to the thermal development apparatus of the second aspect, in the first cooling area, the temperature of the thermal development sheet is reduced and further development progression is suppressed. Therefore, since the development time can be rigorously managed, image quality is less affected by changes in the external temperature, and the deterioration of the image quality due to the difference in the development time can be suppressed.

In the second cooling area, the thermal development sheet is cooled while its inherent weight induces its curling. Therefore, a thermal development sheet that becomes soft at a temperature higher than the softening point temperature of the sheet support member can be naturally cooled without imposing an external load on the sheet, so that the occurrence of vertical creases in the thermal development sheet can be prevented. Further, the rigidity of a thermal development sheet can be increased when its curling is induced by its inherent weight.

In the third cooling area, a thermal development sheet is fed while the curled shape is corrected, and is cooled to a temperature equal to or lower than the softening point temperature of the sheet supporter. Therefore, additional rigidity is imparted to the thermal development sheet, and the deterioration of the image quality due to the physical deformation in the cooling process can be suppressed.

Further, since the sheet temperature is further reduced in the fourth cooling area, so that a thermal development sheet discharged to the outside can immediately be held in the hands, the time required to retrieve and carry to a succeeding step a thermal development sheet that has been discharged can be reduced.

What is claimed is:

1. A thermal development sheet cooling method, for cooling a thermal development sheet that is thermally developed at a predetermined development temperature, comprising:

a first cooling step of employing a rotary member pair, kept at a temperature lower than a development temperature, to sandwich and feed a thermal development sheet that has been developed, and of reducing the temperature of said thermal development sheet to suppress further development progression;

a second cooling step of, following the discharge of said thermal development sheet from said rotary member pair, feeding said thermal development sheet in a non-contact state a predetermined distance through the air at a temperature lower than the temperature of said rotary member pair, thereby cooling said thermal development sheet while the inherent weight thereof induces curling; and a third cooling step of feeding said thermal development sheet while in contact with a guide member, and of cooling said thermal development sheet to a temperature equal to or lower than a softening point temperature of a sheet support member, wherein the cooling of said thermal development sheet is accomplished in said first to said third cooling steps.

2. A thermal development apparatus comprising:

a cooling unit, for cooling a thermal development sheet that is thermally developed at a predetermined development temperature, wherein said cooling unit includes a first cooling area, wherein said cooling unit employs a rotary member pair, kept at a temperature lower than a development temperature, to sandwich and feed said thermal development sheet that is developed, and reduces the temperature of said thermal development sheet to suppress further development progression, a second cooling area, wherein, following the discharge of said thermal development sheet from said rotary member pair, said cooling unit feeds said thermal development sheet in a non-contact state a predetermined distance through the air at a temperature lower than the temperature of said rotary member pair, thereby cooling said thermal development sheet while the inherent weight thereof induces curling, a third cooling area, wherein a guide member is provided along which said thermal development sheet is sandwiched and fed to correct the curved shape thereof, and wherein said cooling unit cools said thermal development sheet to the temperature of a sheet support member that is equal to or lower than a softening point temperature; and a fourth cooling area, wherein discharge rollers are provided for sandwiching and for discharging to the outside said thermal development sheet that is fed along said guide member, and wherein the temperature of said thermal development sheet is further reduced.

* * * * *